United States Patent [19]

Själander

[11] Patent Number: 4,641,716

[45] Date of Patent: Feb. 10, 1987

[54] METHOD AND EQUIPMENT FOR ROCK DRILLING

[75] Inventor: Bo A. Själander, Matfors, Sweden

[73] Assignee: JCC Johnson Construction Company AB, Sundsvall, Sweden

[21] Appl. No.: 627,464

[22] Filed: Jul. 3, 1984

[30] Foreign Application Priority Data

Jul. 6, 1983 [SE] Sweden ..... 8303851

[51] Int. Cl.[4] ..... E21C 11/00; E21D 10/00

[52] U.S. Cl. ..... 175/62; 173/43; 175/162

[58] Field of Search ..... 173/38, 39, 42, 43, 173/44; 175/61, 62, 113, 114, 162

[56] References Cited

U.S. PATENT DOCUMENTS

| | | | |
|---|---|---|---|
| 2,969,844 | 1/1961 | Hamrick | 175/62 X |
| 3,020,012 | 2/1962 | Moracco et al. | 248/16 |
| 3,374,975 | 3/1968 | Bronder | 173/43 X |
| 3,746,104 | 7/1973 | McIntosh et al. | 173/43 |
| 3,967,686 | 7/1976 | Fogelstrom | 173/38 X |
| 3,980,142 | 9/1976 | Grigorieu et al. | 173/43 |
| 3,999,805 | 12/1976 | Lockwood | 173/38 X |
| 4,199,033 | 4/1980 | Van Gundy, Jr. | 173/27 |
| 4,499,953 | 2/1985 | Molin | 173/43 |

FOREIGN PATENT DOCUMENTS

| | | |
|---|---|---|
| 2621774 | 12/1977 | Fed. Rep. of Germany . |
| 363873 | 4/1974 | Sweden . |

*Primary Examiner*—Stuart S. Levy
*Assistant Examiner*—David Werner
*Attorney, Agent, or Firm*—Roylance, Abrams, Berdo & Goodman

[57] ABSTRACT

A drilling equipment and a method is intended for horizontally boring rocks with a low bench height. The drilling equipment can be used as an accessory to an ordinary dredger or the like. The whole drilling equipment is arranged to turn in a plane parallel to the plane of the brackets of the dredger's boom, and the drilling machine itself together with its drill-propulsion unit is arranged to turn in a plane perpendicular to said brackets' plane. These turnings are preferentially effected by hydraulic power from the dredger.

16 Claims, 4 Drawing Figures

METHOD AND EQUIPMENT FOR ROCK DRILLING

The present invention relates to a hydraulically operated drilling equipment for rock drilling and, more particularly, to drilling equipment for attachment to a ordinary dredger or the like instead of its dredger ladle by means of brackets. It is particularly suitable for horizontally drilling rocks with low bench height.

Drilling and blasting rocks with low bench height is usually performed by vertical bores. With lower bench height the bores have to be closer to each other and the tamping be decreased. This means a great number of bores per square meter and a great number of drilled meters per cubic meter of rocks, and also a high specific blasting charge. Besides, rocks under the level of the theoretical bottom of the shaft will be broken and this unnecessary amount of stones must also be loaded. The bottom of the shaft has to be cleaned from upturned points, eventually by blasting, causing high costs and loss of time.

Some exploitation works require a smooth shaft bottom, e.g. for concrete beds. This could be done to a lower price by horizontally drilling rocks with a low bench height providing existence of a suitable and not too expensive apparatus for the purpose.

Prior art apparatus for drilling rocks in a horizontal direction concists of a drifter. It is suitable to its purpose providing the ratio of production to capacity is high. This is, however, not the case by excavation above ground, where there is a temporary need of a drifter, and for this reason the cost for a drifter standing still will be considerable. A drifter is on the whole not useful for certain purposes above ground, such as drilling for trenches and cable channels. It is therefore a need of an equipment for horizontally drilling rocks with low bench height, which is cheaper in operation and has a simple construction compared with prior art. Such a new equipment ought to be applicable to a machine generally used by excavation above ground, e.g. a dredger.

U.S. Pat. No. 4,199,033 discloses a backhoe, a hydraulically powered implement mounted to the rear of a tractor, which is used for an augering apparatus attached as an accessory to the backhoe. The reach of motion of this apparatus is, however, too limited to be useful for all occurring types of horizontal drillings, and, besides, drilling in benches is more complicated and space requiring than earth boring.

The present invention overcomes these and other limitations of prior art constructions for the purpose.

According to the present invention the drilling equipment, which has been attached to a dredger or the like instead of its dredger ladle by means of brackets, shall be so arranged that the plane indentified by the brackets shall be brought in a substantially vertical position. This can be done by using the hydraulic system of the dredger. Then, the drilling machine itself together with its propulsion unit shall be turned to a substantially horizontal position along a plane, which is perpendicular to the plane of the brackets. Moreover, the drilling equipment shall be turned to a desirable drilling position along a plane, which is parallel to the plane of the brackets. An apparatus according to the invention shall comprise arrangements for these turnings.

The invention is described with reference to the annexed drawings, wherein.

Figure 3:
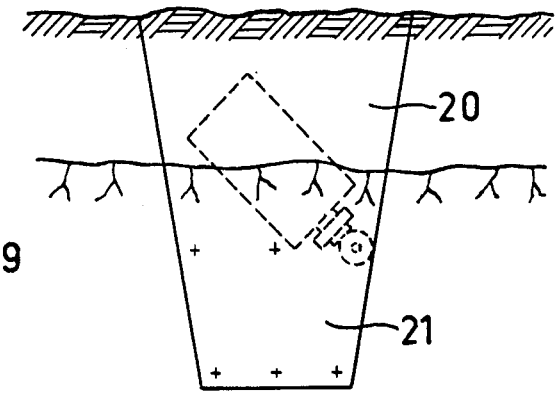
Figure 4:
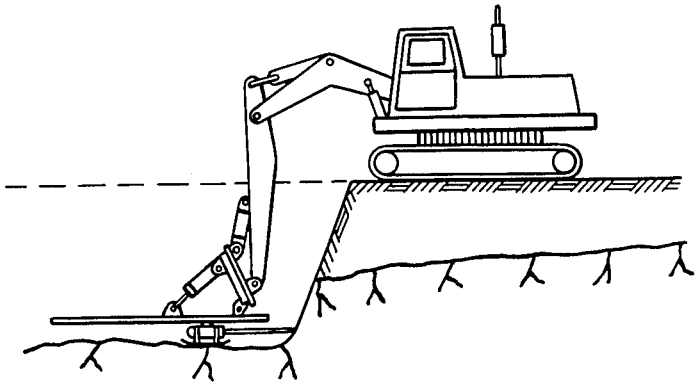

FIG. 3 indicates the drilling equipment into a cable channel with earth surface and a bedrock, FIG. 4 shows a dredger with the drilling equipment in working position.

Corresponding reference characters indicate corresponding parts throughout all drawings.

Figure 1:
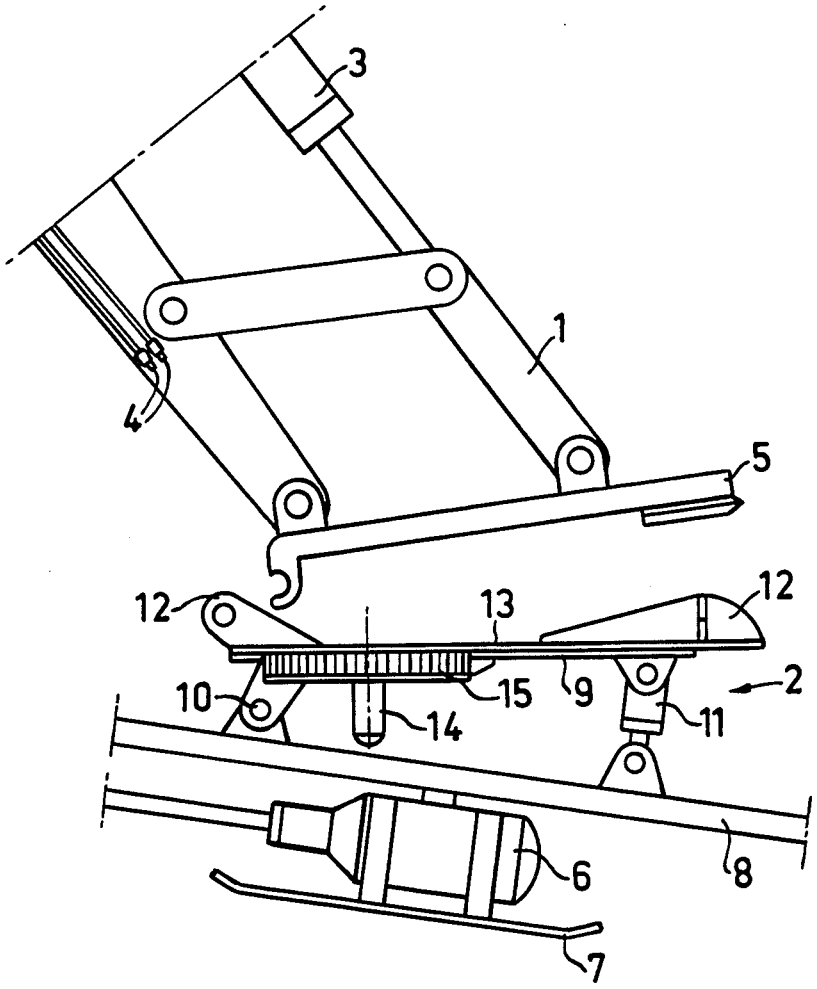
FIG. 1 is a side view of a drilling equipment.

FIG. 1 illustrates the outer boom 1 of a dredger, and a drilling equipment, indicated generally at reference number 2. This drilling equipment is not yet attached at the boom. One of the hydraulic cylinders of the boom is indicated at 3. Fittings 4 for hydraulic power are visible and also the ordinary brackets 5 for a dredger ladle.

The drilling equipment 2 comprises a hydraulically driven drilling machine 6 with a saddle 7 as a cover for the machine, a drill-propulsion unit 8, e.g. a chain feeder driven by a hydraulic motor ( not shown ). The drill-propulsion unit 8 is pivotally secured to a plane 9 at the axle 10. The pivoting is effected by means of a hydraulic cylinder 11. The drilling equipment 2 is attached to the boom 1 of the dredger instead of its dredger ladle by means of brackets 12, corresponding the brackets 5 of the boom. These brackets 12 of the drilling equipment are attached to a plane 13 essentially consisting of griders or platings. The plane 9, also consisting of griders or platings, together with other devices attached to this plane is pivotally secured to the plane 13 by means of gear rings 15 and a hydraulic motor 14.

To the drilling equipment belongs means for compressed air supply for dust separating and cleaning, valves for the hydraulic system and a guidance control system. This control system can be stationary inside the driving compartment of the dredger, but may also be portable for a person outside. At least the drilling machine 6 and the hydraulic motor 14 may be regulated by the hydraulic power obtained through the fittings 4 from the hydraulic system of the dredger.

The whole drilling equipment 2 is erected to a single unit, easily attachable to the dredger instead of its dredger ladle. A pair of flexible tubings for the regulation of the drilling equipment have to be connected to the fittings 4.

Figure 2:
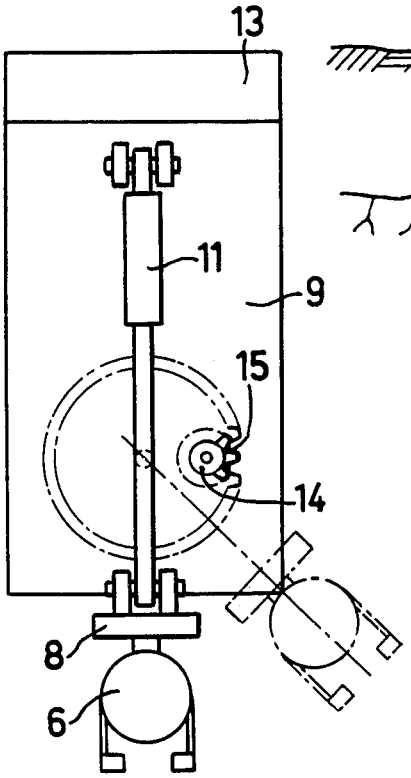
FIG. 2 is a horizontal view of the equipment ready for drilling.

According to the method of the invention the following steps have to be taken, but the relative order of the course is irrelevant, the order proposed is preferred. In FIG. 2 the drilling equipment is visible from a front in a direction towards the dredger and in a working position. The brackets of the dredger have been placed in a substantially vertical plane. The plane 9 with the drilling equipment attached is parallel to the plane 13 with the brackets and accordingly substantially vertical. The drill-propulsion unit 8 together with the drilling machine 6 is by means of the cylinder 11 turned down to a substantially horizontal position around the axle 10. The drilling machine is now in a position for drilling a bore in a direction towards or away from the dredger depending on the installed direction of the drilling machine. According to the invention it shall, however, be possible to carry out one more turning for the purpose to be able reaching all points for bores, which by any reason may be difficult to reach. This turning of the plane 9 in relation to the plane 13 with the brackets is performed by the hydraulic motor 14 and the gear rings 15. The drilling machine can with this turning come in a position among others shown in FIG. 2 by broken lines.

A drilling equipment realizing the method just described shall include means 14, 15 for turning the drilling machine in a plane 9 parallel to the plane 13 with the brackets, and means 11 for turning the drilling machine 6 together with its drill-propulsion unit 8 in a plane perpendicular to the plane 13 of the brackets. It is not necessary that the turning means are constructed as herein described, but every known arrangements suitable for the turnings may be used. Thus, suitable turning means without gear rings are obtainable, and the cylinder 11 may for instance be placed at the attachements for the axle 10.

The costs for drilling benches can with the present invention be considerably reduced, in many cases halved, in comparison with the use of prior art drilling equipments. It is especially advantageous to drilling benches together with excavation of trenches or cable channels. FIG. 3 shows such a trench or cable channel with an earth layer 20 uppermost and a bedrock 21 below, which has to be blasted. The profile of the drilling machine is here shown by broken lines and a number of bores for blasting are indicated by centre marks.

FIG. 4 illustrates the working with such a cable channel where first the blast holes are drilled and the blasting is effectuated, and then the excavation of the blast stones together with the earth masses is carried out. According to prior art the earth masses must firstly be excavated and thereafter the blast holes could be bored and the blasting effectuated. Then the channel has to be refilled by earth masses to make it possible for the dredger to reach the blast stones for excavation of all masses.

It is of course possible to drill vertical holes with an equipment according to the present invention if required. Various modifications could also be made in the constructions herein described without departing from the scope of the invention. Instead of the turning means made hydraulically it is, for example, possible to use electrically driven equipments. Instead of a dredger a wheeled charger or a digging tractor could be used. It is intended that all matter in the foregoing description and shown in the accompanying drawings discloses the best mode contemplated for carrying out the invention, but shall be as interpreted as illustrative rather than limiting.

I claim:

1. Drilling equipment for horizontally drilling rocks with a low bench height, said equipment being attachable to a boom of a dredging machine, said equipment comprising:

brackets attachable to said boom;

a first plate attached to said brackets;

a second plate rotatably attached to said first plate, said second plate being rotatable about a first axis which is perpendicular to said first plate;

a plate member rotatably attached to said second plate, said member being rotatable about a second axis perpendicular to said first axis;

hydraulic cylinder means extending between and being connected to said second plate and said member;

a drilling motor attached to said member; and a drill bit connection extending outward from said drilling motor.

2. Drilling equipment according to claim 1 wherein:

said member is rotatably attached to said second plate at first locations on said member and said second plate;

said hydraulic cylinder means being connected to said member and said second plate at second locations on said member and said second plate;

said second locations being spaced from said first locations.

3. Drilling equipment according to claim 2 further comprising:

power means for rotating said second plate relative to said first plate.

4. Drilling equipment according to claim 3 wherein:

said power means is hydraulically operated.

5. Drilling equipment according to claim 4 wherein:

said power means includes a hydraulic motor, a first gear ring attached to said first plate and a second gear ring attached to said second plate.

6. Drilling equipment according to claim 1 wherein:

said first and second plates are designed to be vertically oriented when a horizontal bore is being drilled.

7. Drilling equipment according to claim 1 wherein:

the axis of said drill bit connector is perpendicular to said first and second plates when a horizontal bore is being drilled.

8. Drilling equipment according to claim 1 wherein:

said brackets are attachable to dredger ladle brackets.

9. Drilling equipment according to claim 1 further comprising:

a saddle connected to said drilling motor on the opposite side from said member.

10. Drilling equipment according to claim 1 wherein said second plate is oriented parallel to said first plate.

11. Drilling equipment for horizontally drilling rocks with a low bench height, said equipment being attachable to a boom of a dredging machine, said equipment comprising:

brackets attachable to said boom;

a first plate attached to said brackets;

a second plate rotatably attached to said first plate, said second plate being rotatable about a first axis which is perpendicular to said first plate;

a plate member rotatably attached to said second plate at a pivot connection;

drilling motor attached to said member;

a drill bit connection extending outward from said drilling motor;

means for positioning the member perpendicular to said first plate; and means for rotating the member around said first axis.

12. Drilling equipment according to claim 11 wherein:

said pivot connection is offset from said first axis.

13. Drilling equipment according to claim 12 wherein:

the axis of said pivot connection is perpendicular to said first axis.

14. Drilling equipment according to claim 13 further comprising:

hydraulic cylinder means extending between and being connected to said second plate and said member at first locations, said first locations being spaced from said pivot connection.

15. Drilling equipment according to claim 14 further comprising:

power means for rotating said second plate relative to said first plate.

16. Drilling equipment according to claim 15 wherein:

said power means including gear rings which form the connection between said first and second plates.

* * * * *